US007967873B1

(12) United States Patent
Guthrie

(10) Patent No.: US 7,967,873 B1
(45) Date of Patent: Jun. 28, 2011

(54) DYED TEXTILE ARTICLE AND DYE BATH ASSISTANT

(75) Inventor: Darrin McBane Guthrie, Snow Camp, NC (US)

(73) Assignee: Bozzetto, Inc., Greensboro, NC (US)

( * ) Notice: Subject to any disclaimer, the term of this patent is extended or adjusted under 35 U.S.C. 154(b) by 796 days.

(21) Appl. No.: 11/392,278

(22) Filed: Mar. 29, 2006

(51) Int. Cl.
*D06P 5/06* (2006.01)

(52) U.S. Cl. ..... 8/557; 8/172; 8/169; 8/607

(58) Field of Classification Search ..... 8/490, 607, 8/169, 172, 557
See application file for complete search history.

(56) References Cited

U.S. PATENT DOCUMENTS

| | | | | |
|---|---|---|---|---|
| 2,953,423 | A * | 9/1960 | Buc | 8/593 |
| 3,918,901 | A * | 11/1975 | Ida et al. | 8/535 |
| 4,705,527 | A | 11/1987 | Hussamy | 8/558 |
| 4,780,105 | A | 10/1988 | White et al. | 8/574 |
| 4,812,139 | A | 3/1989 | Brodmann | 8/490 |
| 4,981,488 | A | 1/1991 | Cates et al. | 8/574 |
| 5,207,803 | A * | 5/1993 | Holsten et al. | 8/586 |
| 5,215,545 | A | 6/1993 | Cates et al. | 8/490 |
| 5,250,245 | A * | 10/1993 | Collins et al. | 264/103 |
| 6,551,362 | B2 | 4/2003 | Guthrie et al. | 8/607 |
| 6,645,468 | B2 | 11/2003 | Cutie et al. | 424/45 |
| 6,840,967 | B1 | 1/2005 | Riggins et al. | 8/586 |
| 2005/0155163 | A1 * | 7/2005 | Griffin et al. | 8/662 |

* cited by examiner

*Primary Examiner* — Harold Y Pyon
*Assistant Examiner* — Timothy Chiang
(74) *Attorney, Agent, or Firm* — MacCord Mason PLLC

(57) ABSTRACT

A dyed textile article. The dyed textile article includes a synthetic fiber substrate and a dye affixed to the substrate in a dye process that includes a using a dye assistant having an amidic nitrogen adjacent to an aromatic ring. The dye assistant may be N-methyl formanilide. The substrate of the present inventions may be a variety of substrates and is most preferably an aromatic polyamide. The present inventions also include a dye bath and a method of dyeing using a dyeing assistant having an amidic nitrogen adjacent to an aromatic ring.

17 Claims, 1 Drawing Sheet

DYED TEXTILE ARTICLE AND DYE BATH ASSISTANT

BACKGROUND OF THE INVENTION (1) Field of the Invention

The present invention relates generally to dyed textile articles and, more particularly, to a method of dyeing a synthetic fiber substrate using a dyeing assistant having an amidic nitrogen adjacent to an aromatic ring.

(2) Related Technology

The use of dyeing assistants to aid in the dyeing of various fibers is well known in the art. Such assistants are sometimes used for their ability to increase dyeing efficiency. They may also be important for dyeing fibers that are otherwise difficult to dye. For example, some polyamides and polyesters are difficult to dye. In particular, among the polyamides, aromatic polyamides are difficult to dye and typically require a dyeing assistant to achieve satisfactory dyeing. The choice of dyeing assistants, however, is few. Referring, for example to the aromatic polyamides, only a handful of compounds are known as dyeing assistants. For example, three of those compounds are:

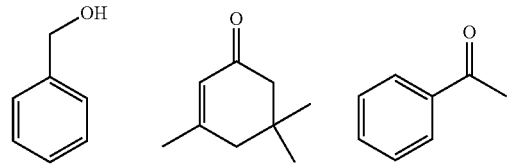

benzyl alcohol isophorone acetophenone

Further, while some dye assistants are commercially available, for example, CINDYE NPC (isophorone) and CINDYE C-45 are both available from Bozzetto, Inc. of Greensboro, N.C., not all dye assistants are commercially practical.

Acetophenone, by way of example, is not a practical assistant because of its adverse characteristics. For example, it has adverse effects on humans, as well as, machinery and the water supply. Somewhat similarly, CINDYE NPC, while beneficial as a dyeing assistant, is classified as an air pollutant by the Environmental Protection Agency and requires additional monitoring and reporting. Some may find that these requirements do not make the use of CINDYE NPC cost effective. Thus, the available selection of dyeing assistants is not large, and even those available leave something to be desired in terms of their overall performance on aromatic polyamides. For example, they do not result in the most efficient dyeing, nor do they allow for various depths of shade. Such shortcomings are important for several reasons.

Dyes themselves are expensive, and any unfixed dye or amount of dye used in excess creates unnecessary waste, which increases production costs and waste-treatment costs. Further, and particularly so with aromatic polyamides, the available selection of dyes is limited.

Thus what is needed is a new dye assistant, and in particular, a dye assistant that creates an improved shade choice in dyed textiles. In addition, a dye assistant is needed that allows for more efficient dyeing of textile articles, such as polyamides or polyesters, and in particular, that allows for more efficient dyeing of aromatic polyamides. Also there exits a need for a new dye assistant that creates a variety of color shades from a single dye simply by altering the pH of the dye bath.

SUMMARY OF THE INVENTION

The present inventions are directed to a dyed textile article. The dyed textile article includes a synthetic fiber substrate and a dye affixed to the substrate in a dye process that includes a using a dye assistant. While a variety of processes may be used, applicants prefer bath dyeing and print paste dyeing.

The dye assistant has an amidic nitrogen adjacent to an aromatic ring, and more preferably, the dye assistant is the compound represented by Formula I:

Formula I

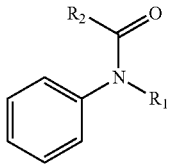

wherein $R_1$ and $R_2$ may be H, or 1-15 carbon alkyl groups selected from the group consisting of linear, branched, substituted, unsubstitued, homo cyclic, hetero cyclic, and aromatic ring structures. Even more preferably, $R_1$ and $R_2$ may be H or substituted or unsubstitued $C_{1-6}$. Even more preferably still, the dye assistant is N-methyl formanilide.

The substrate of the present inventions may be a variety of substrates and is preferably a polyamide or polyester or cationic dyeable polyester. More preferably, the substrate is an aromatic polyamide, such as, for example, KEVLAR, NOMEX or TWARRON.

A variety of dyes may be used to achieve the present inventions, and different dyes may be preferred depending on the dye process employed and the substrate. For example, in some dye processes, such as bath dyeing, where aromatic polyamides are being dyed, basic dyes are preferred, yet dyeing is still achieved with acidic dyes. In other processes, such as dye printing polyester or aromatic polyamides, the present inventions are preferably achieved with acidic dyes.

The textile article of the present inventions may also include at least one fabric enhancer, such as, a fire retardant or an ultraviolet light absorber.

The present inventions also include a dye bath for dyeing a synthetic fiber substrate. The bath includes a dye, which may be, for example, basic; a salt, such as sodium nitrate; and a dye assistant having an amidic nitrogen adjacent to an aromatic ring for facilitating attachment of the dye to the substrate. Preferably, the dye assistant is the assistant of Formula I and more preferably, the dye assistant is N-methyl formanilide. The dye bath may also include a pH adjuster, such as acetic acid.

In certain embodiments, pH may be adjusted to produce a variety of color shades. For example, using a single dye and the dye assistant of the present invention, pH may be lowered to produce a darker shade or raised to produce a lighter shade. For example, a pH of 2.75 may be used to produce a darker shade and a pH of 4.5 may be used to produce a lighter shade. Still, by using other pHs, other shades may be produced.

Other embodiments of the present inventions also include a method of dyeing a synthetic fiber. The method includes exposing the fiber to dye in the presence of an assistant having an amidic nitrogen adjacent to an aromatic ring. For methods including dye baths, preferably, the dye is a basic dye, yet acidic dyes work as well; for methods including print pasting, preferably the dye is an acidic dye. In addition, for methods of dyeing employing a combination of techniques, a variety of acidic or basic dyes may be preferred. Preferably, the amide dye assistant is the compound of Formula I and more preferably, the amide dye assistant is N-methyl formanilide. The method also includes adjusting the pH of the exposing to alter pigmentation of the synthetic fiber. For example, adjusting may be lowering pH to create a darker pigmentation or raising pH to create a lighter pigmentation.

Accordingly, one aspect of the present inventions is to provide a dyed textile article including: a synthetic fiber substrate; and a dye affixed to the substrate in a dye process, wherein the dye process includes a dye assistant having an amidic nitrogen adjacent to an aromatic ring for facilitating attachment of the dye to the substrate.

Another aspect of the present inventions is to provide a dye bath for dyeing a synthetic fiber substrate including: a dye; a salt; and a dye assistant having an amidic nitrogen adjacent to an aromatic ring for facilitating attachment of the dye to the substrate.

Still another aspect of the present inventions is to provide a dyed textile article including: a synthetic fiber substrate; a dye affixed to the substrate in a dye process, wherein the dye process includes: (i) a dye; (ii) a salt; and (iii) a dye assistant having an amidic nitrogen adjacent to an aromatic ring for facilitating attachment of the dye to the substrate; and at least one fabric enhancer.

Still another aspect of the present invention is to provide a method of dyeing a synthetic fiber including exposing the fiber to a dye in the presence of a dye assistant having an amidic nitrogen adjacent to an aromatic ring.

These and other aspects of the present invention will become apparent to those skilled in the art after a reading of the following description of the preferred embodiment when considered with the drawing.

DESCRIPTION OF THE PREFERRED EMBODIMENTS

Figure 1:
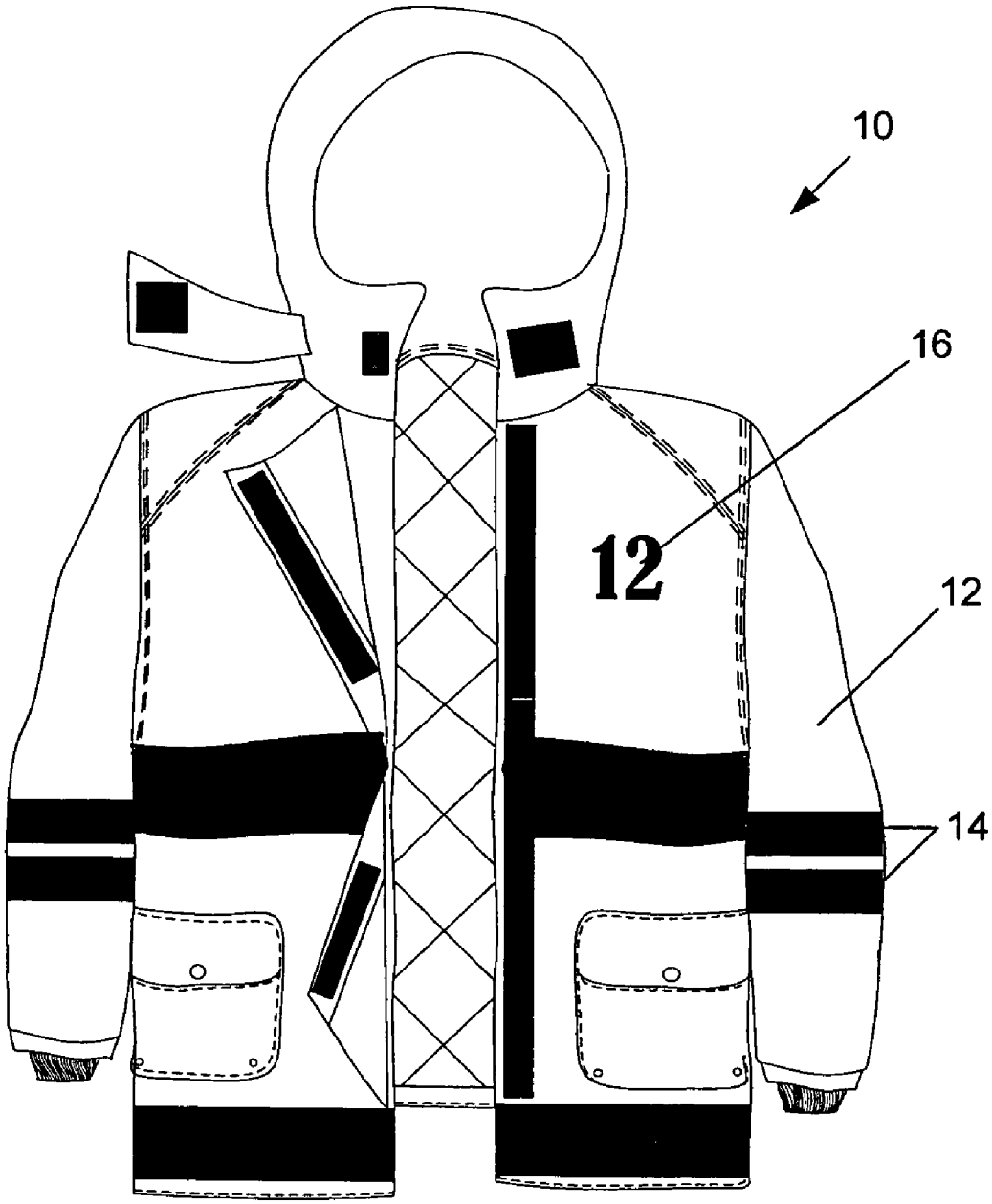
FIG. 1 shows a dyed textile article of the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

FIG. 1 shows one embodiment of a dyed textile article 10 of the present invention. In this embodiment, the dyed textile article 10 is a heat and flame retardant jacket, such as a fireman's or mechanic's jacket, which may be referred to as a turnout jacket. Jacket 10 includes dyed portions 12 and various reflective portions 14. Additionally, jacket 10 includes a printed portion 16, shown printed with the number "12".

While the article 10 is shown as a jacket, others, making other embodiments, will recognize that the textile article of the present inventions is not limited to a fireman's jacket or any type of jacket. Rather the textile article may be any type of textile article, such as any number and style of vests, pants, shirts, shorts, dresses head coverings, boots, shoes, gloves or aprons for example. Even still, the present inventions are not limited to garments or apparel. For example, the present inventions may include sheets of textile, e.g. sheets used for use in cut-and-sew operations. Additionally, textile articles have a variety of other shapes or applications. For example, they may include tires or ropes, or structural components such as composite and honeycomb articles for building products ranging from airplane parts, bicycle frames, canoes and kayak to various electrical components or chips for electrical components.

Referring to garments, while the textile article is preferably woven for increased strength or wear-ability in some applications, e.g. turnout jackets, there is no limitation to the type of construction that can be used in the present invention. By way of example, any number of knitting, non-woven or composite construction techniques can also be used, which all would be within the scope of the present invention.

In preferred embodiments, the textile article will be constructed of a polyamide fiber and in particular, of an aromatic polyamide. Those skilled in the art will recognize a variety of such textiles. By way of example, NYLON, KEVLAR, TWARRON and NOMEX are all preferred textiles of the present invention. Also, combinations of such textiles are suitable for achieving the present invention. For example, a TWARRON/NOMEX combination, or other combinations, are ideal for the present invention.

Because of the nature of the synthetics that can be used to achieve the present invention, many of the textile articles may have unique characteristics, which make them ideal for special tasks. For example, many of the NOMEX articles are flame and heat retardant, and are ideal for articles such as the fireman's jacket depicted in FIG. 1. Similarly, KEVLAR textiles are well known for their strength, and may be ideal for textiles articles ranging from bullet proof vests to cut-resistant gloves.

Other types of textiles used for the present inventions may have other characteristics that make them ideal for other applications. Polyamides, e.g. NYLON, and polyesters, and in particular cationic dyeable polyesters, can be used to make a similarly wide variety of textile articles. Additionally, numerous stretch articles may benefit from the present invention, for example, NYLON and SPANDEX blends and other NYLON blends and heat set textiles.

Referring back to FIG. 1, jacket 10 is composed of a synthetic fiber substrate that has a dye affixed to the substrate. Preferably, the dye is a basic dye or cationic dye having a positive charge. For example, the dye may be Astrazon Olive Green BL and Astrazon Orange 3RL (also known, respectively, as Basic Green 6 and Basic Orange 27, and both formerly manufactured by Verona Dyestuffs) and Basic Yellow 21, Basic Blue 41, and Basic Red 18 (further identified in the color index, third edition, published by the Society of Dyers and Colourists, Dean House, Piccadilly Bradford, Yorkshire, England). Also useful as cationic dyes are Red GL, Yellow 5GL, Blue X-3GL-300, and Red FB, sold under the trade name BASACRYL by BASF Corporation. The article might include any combination of such dyes. By way of example, the dyes could also be acidic dyes, which could be, for example, Lanacet Green B or Polar Red RL, both available from CIBA Company.

For some textile articles, the ability of a fiber substrate to accept a dye may be important for aesthetic reasons, yet in many instances, particularly, with aromatic polyamides, colors may serve important functions. For example, colors may improve the visibility of the article, which may be important for articles made for rescue workers. Similarly, colors may help distinguish the wearer of an article, which may be important for, for example, mechanics working in pit row at a stock car racing event. Still, colors may be important for distinguishing articles having important characteristics. For example, color may be important for allowing meat-processing employees to distinguish between gloves that provide enhanced cut-protection and those that do not. Similarly, for electronic applications, where textiles, such as NOMEX, may serve as insulation or circuit boards, color may be used to distinguish one type of wire from another or one circuit board from another.

Moreover, rather than distinguish, colors may also be used to help articles blend in. The ability to blend in may be increasingly important in camouflage applications, for example, for camouflage KEVLAR vests or for other composite KEVLAR articles. Additionally, being able to provide such articles in new colors that were not previously available may increase salability. Also, being able to more efficiently produce dyed articles may decrease cost, which may allow more consumers to purchase such products. In terms of safety products, an ability to purchase safety articles, where one did not previously exist, may decrease injury to members of the population who might otherwise be injured.

The dye, in some embodiments of the present invention, is preferably affixed to the substrate during the dyeing process with the assistance of a dye assistant, for example, which may be present in a dye bath or print paste. The textile article will, in some embodiments, include the dyeing assistant. In some embodiments, for example, it may not be practical or cost effective to remove the dye assistant from the textile article. By way of example, in such embodiments, the dye assistant may yield an amide peak when analyzed by infrared analysis after extraction from the textile article. Still, in other embodiments, others may desire to remove the dye assistant from the textile article. Such embodiments are still within the scope of the present invention.

Preferably, the dye assistant having an amidic nitrogen adjacent to an aromatic ring is the compound N-methylformanilide of the structure below.

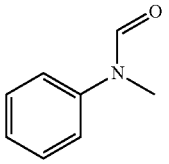

N-methylformanilide

Yet, applicants predict that variants of the proposed assistant, e.g. various substitutions to the nitrogen and carbon of the amide group, may perform similar to N-methylformanilide. For example, applicants predict that dye assistants that are the compound of Formula I Formula I

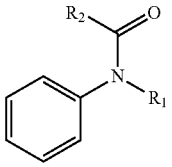

wherein $R_1$ and $R_2$ may be H, or 1-15 carbon alkyl groups selected from the group consisting of linear, branched, substituted, unsubstitued, homo cyclic, hetero cyclic, and aromatic ring structures, will be suitable for performing various aspects of the present invention. More particularly, applicants predict that compounds of Formula I, wherein $R_1$ and $R_2$ are selected from the group consisting of H and $C_{1-6}$, will be suitable for performing various aspects of the present invention.

While synthesis of the present assistant may be performed by numerous synthesis reactions, applicants prefer Reaction 1, illustrated below, for synthesizing the compound displayed:

Reaction 1

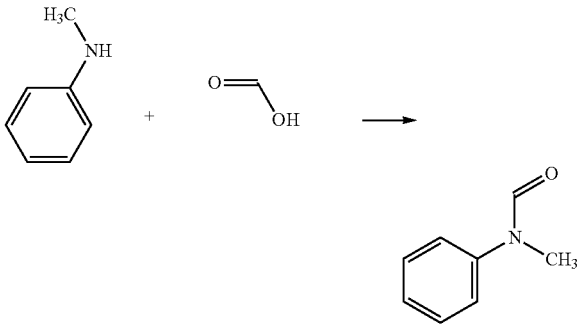

As shown in FIG. 1, the textile article 10 might be printed 16. Printing may be achieved by a variety of methods, including, for example, preparing a print paste using a dye assistant of the present invention. Additionally, printing may be performed by bath dyeing using a dye assistant of the present invention, followed by printing with a print paste, whereby residual dye assistant from bath dyeing further facilitates printing.

Some may also prefer to include at least one fabric enhancer in the textile article. Those skilled in the art will recognize a variety of fabric enhancers, or products that improve or alter various properties of a textile article. For example, the fabric enhancer may be a fire retardant, such as, for example a sulphate containing retardant or a phosphorous containing retardant. Preferably, the fire retardant is ammonium sulfate or ammonium phosphate, yet others may prefer other retardants, which are within the scope of the present invention.

Still, others may prefer other enhancers, and may include, for example, ultraviolet light absorbers on the textile. Those skilled in the art may recognize that certain chemicals may act as ultraviolet light absorbers and other chemicals may act as ultraviolet light blockers, but for the purposes of this specification, ultraviolet light absorbers is intended to mean any additive the increases ultraviolet resistance and is not intended to be limited to any particular mechanism. Examples of such absorbers include products based on benzotriazole and hindered amines, for example.

The present inventions also include a dye bath for dyeing a synthetic fiber substrate. Those skilled in the art will recognize that numerous dye baths or other dyeing machines could be used to achieve the present invention. For example, the dye bath may achieve dyeing through beam, beck, jet and jig processing.

The dye bath may include numerous components. For example, it may include a dye, such as a basic dye, for example, some of the basic dyes listed above. Preferably, the dye is present in an amount between about 0.1% and 20% OWG (on weight of goods), and more preferably, the dye is present in an amount between about 1% and 10% OWG.

The dye bath may include a salt, which is preferably a nitrate salt, and more preferably sodium nitrate. Some, however, may prefer sodium chloride. Applicants prefer to use about 1 to about 2 weight % of salt. Additional additives, e.g. various emulsifiers and surfactants may also be added to improve dyeing.

The dye bath may include a dye assistant having an amidic nitrogen adjacent to an aromatic ring. As mentioned, the dye assistant facilitates attachment of the dye to the substrate. The dye assistant may be present in any amount that allows dyeing. Applicants preferably use between about 10 and 70 grams per liter OWB (on weight of bath) of the dye assistant, and more preferably use between about 20 and 40 grams per liter OWB of the dye assistant. As mentioned, numerous variations of the dye assistant can be used to achieve the present invention, yet applicants prefer N-methylformanilide.

The dye bath may include a pH adjuster, for adjusting the pH of the bath. One of the benefits of the present inventions is the ability to alter the shade of a dyed article simply by altering the pH of the dyeing process, for example, the pH of a dye bath. Preferably, the pH adjuster is an organic acid, and may be, for example, citric acid, formic acid, acetic acid or mixtures thereof. Others may prefer other adjusters, such as other organic or inorganic acids, which are within the scope of the present invention.

For purposes of the present embodiment, applicants prefer the pH of the dye bath to be between about 2 and about 5. With regards to specific pH, however, that will depend on the dye used and on the desired color of the textile article. Generally, a lower pH produces a deeper depth of shade and a higher pH produces a lighter depth of shade. More specifically, applicants have found that a pH between about 2 and 3.3 produces the deeper depth of shade and a pH between about 3.4 and 5, and more preferably between about 3.5 and 5, produces the lighter depth of shade.

When bath dyeing, while there is no real limitation to the order of steps needed to perform the present invention, applicants prefer to add the dye, the salt, and the assistant in the desired amount and then adjust the pH to desired level. The textile is added to the bath and the bath is brought to temperature. For applicants' purposes, heating to temperatures between about 250° F. and 270° F. is ideal. Others however may wish to heat the bath to temperature and then add the textile, or adjust pH at some later step in the dyeing process. All such variations, including variations with the addition of dye, dye assistant and salt, are within the scope of the present invention.

Textile articles produced in the dye bath of the present inventions exhibited depth of dyeing similar or greater to that of dyeing achieved with known carriers. Dyeing using the present inventions achieved full penetration. Additionally, lightfastness, which is typically low for basic dyes, is not further impaired by the present invention. Lightfastness was found to be roughly the same for textile articles dyed using the present inventions as for textile articles dyed using known dye assistants. Similarly, lightfastness was approximately the same internally and externally for articles of the present invention.

EXAMPLES

Example 1

A stock dye mixture was made using 3.0% Basic Blue 1 (200%). Three aqueous dye baths were prepared, each containing stock dye, dye assistant and salt. Bath pH was adjusted to pH 2.75 using acetic acid. Baths were as follows:

Bath A (Comparison)
40 g/L CINDYE C-45 (dye assistant)
20 g/L Sodium Nitrate
5 ml stock dye mixture
Bath B (Comparison)
40 g/L Acetophenone (dye assistant)
20 g/L Sodium Nitrate
5 ml stock dye mixture
Bath C (the Invention)
40 g/L N-methylformanilide (novel dye assistant)
20 g/L Sodium Nitrate
5 ml stock dye mixture A sample of KEVLAR staple fabric was added to each bath and dyed at about 265° F. for about 1 hour.

The dye assistant of Bath A and the dye assistant of Bath B produced dyed textile articles of substantially the same color. The novel dye assistant of Bath C produced a textile article that was a different and much darker shade of blue than the articles produced in Bath A and B.

Example 2

A stock dye mixture was made using 3.0% Basic Blue 1 (200%). Three aqueous dye baths were prepared, each containing stock dye, dye assistant and salt. Bath pH was adjusted to pH 2.75 using acetic acid. Baths were as follows:

Bath A (Comparison)
40 g/L CINDYE C-45 (dye assistant)
20 g/L Sodium Nitrate
5 ml stock dye mixture
Bath B (Comparison)
40 g/L Acetophenone (dye assistant)
20 g/L Sodium Nitrate
5 ml stock dye mixture
Bath C (the Invention)
40 g/L N-methylformanilide (novel dye assistant)
20 g/L Sodium Nitrate
5 ml stock dye mixture A sample of 450 NOMEX fabric was added to each bath and dyed at about 265° F. for about 1 hour. The dye assistant of Bath A and the dye assistant of Bath B produced dyed textile articles of substantially the same color. The novel dye assistant of Bath C produced a textile article that was a different and much darker shade of blue than the articles produced in Bath A and B.

Example 3

A stock dye mixture was made using 1.5% BASACRYL RED GL. Three aqueous dye baths were prepared, each containing stock dye, dye assistant and salt. Bath pH was adjusted to pH 2.75 using acetic acid. Baths were as follows:

Bath A (comparison)
40 g/L CINDYE C-45 (dye assistant)
20 g/L Sodium Nitrate
5 ml stock dye mixture
Bath B (Comparison)
40 g/L CINDYE NPC (dye assistant)
20 g/L Sodium Nitrate
5 ml stock dye mixture
Bath C (the Invention)
40 g/L N-methylformanilide (novel dye assistant)
20 g/L Sodium Nitrate
5 ml stock dye mixture A sample of 455 NOMEX fabric was added to each bath and dyed at about 265° F. for about 1 hour. The dye assistant of Bath A and the dye assistant of Bath B produced dyed textile articles of substantially the same pink/red color. The novel dye assistant of Bath C produced a textile article that was a different and much darker shade of purple than the pink/red articles produced in Bath A and B.

Example 4

A stock dye mixture was made using 3.0% Sevron Golden Yellow GL (200%). Three aqueous dye baths were prepared, each containing stock dye, dye assistant and salt. Bath pH was adjusted as described below using acetic acid. Baths were as follows:

Bath A (Comparison)
40 g/L CINDYE C-45 (dye assistant)
20 g/L Sodium Nitrate
pH 2.75
Bath B (the Invention)
40 g/L N-methylformanilide (novel dye assistant)
20 g/L Sodium Nitrate
pH 2.75
Bath C (the Invention)
40 g/L N-methylformanilide (novel dye assistant)
20 g/L Sodium Nitrate
pH 4.5

A sample of 455 NOMEX fabric was added to each bath and dyed at about 265° F. for about 1 hour. At different pHs, textile articles produced in Bath A (pH 2.75) and textiles produced using the novel dye assistant in Bath C (pH 4.5) were approximately the same orange color. At the same pH, the novel dye assistant of Bath B (pH 2.75) produced a textile article that was a brown shade and different from the textile article produced in Bath A (pH 2.75).

Example 5

A stock dye mixture was made using 3.0% Sevron Fast Red GRL (200%). Three aqueous dye baths were prepared, each containing stock dye, dye assistant and salt. Bath pH was adjusted as described below using acetic acid. Baths were as follows:

Bath A (Comparison)
40 g/L CINDYE C-45 (dye assistant)
20 g/L Sodium Nitrate
pH 2.75
5 ml stock dye mixture
Bath B (the Invention)
40 g/L N-methylformanilide. (dye assistant)
20 g/L Sodium Nitrate
pH 2.75
5 ml stock dye mixture
Bath C (the Invention)
40 g/L N-methylformanilide. (novel dye assistant)
20 g/L Sodium Nitrate
pH 4.5
5 ml stock dye mixture A sample of 455 NOMEX fabric was added to each bath and dyed at about 265° F. for about 1 hour. At different pHs, articles produced in Bath A (pH 2.75) and articles produced using the novel dye assistant in Bath C (pH 4.5) were substantially the same deep red color. At the same pH, the novel dye assistant of Bath B (pH 2.75) produced a textile article that was a deep purple shade and darker from the different from the textile article produced in Bath A (pH 2.75).

Example 6

A stock dye mixture was made using 3.0% Basic Blue 1 (200%). Three aqueous dye baths were prepared, each containing stock dye, dye assistant and salt. Bath pH was adjusted to pH 2.75 using acetic acid. Baths were as follows:

Bath A (Comparison)
30 g/L CINDYE C-45 (dye assistant)
15 g/L Sodium Nitrate
5 ml stock dye mixture
Bath B (Comparison)
30 g/L Acetophenone (dye assistant)
15 g/L Sodium Nitrate
5 ml stock dye mixture
Bath C (the Invention)
30 g/L N-methylformanilide (novel dye assistant)
15 g/L Sodium Nitrate
5 ml stock dye mixture A sample textile article of 60% TWARRON and 40% TYPE 62 NOMEX was added to each bath and dyed at about 265° F. for about 1 hour. The dye assistant of Bath A and the dye assistant of Bath B produced dyed textile articles of substantially the same blue/green color. The novel dye assistant of Bath C produced a textile article that was deep blue and darker than the blue/green article produced by Baths A and B.

Example 7

A stock dye mixture was made using 1.5% Sevron Fast Red GL (200%). Three aqueous dye baths were prepared, each containing stock dye, dye assistant and salt. Bath pH was adjusted to pH 2.75 using acetic acid. Baths were as follows:

Bath A (Comparison)
40 g/L CINDYE C-45 (dye assistant)
20 g/L Sodium Nitrate
5 ml stock dye mixture
Bath B (Comparison)
CINDYE NPC (dye assistant)
20 g/L Sodium Nitrate
5 ml stock dye mixture
Bath C (Comparison)
40 g/L Acetophenone (dye assistant)
20 g/L Sodium Nitrate
5 ml stock dye mixture
Bath D (the Invention)
40 g/L N-methylformanilide (novel dye assistant)
20 g/L Sodium Nitrate
5 ml stock dye mixture A sample textile substrate of TWARRON staple fiber was added to each bath and dyed at about 265° F. for about 1 hour. The dye assistants of Bath A, Bath B and Bath C produced dyed substrate of substantially the same red color. The novel dye assistant of Bath D produced a burgundy substrate that was a darker than the products of Baths A, B and C.

Example 8

A 10 gram sample of Nomex Type 455 was immersed in a 100 ml dye bath solution containing:

3.0% owg anionic retarding agent, such as Cinlevel FA (Bozzetto product).
3.0% owg sodium nitrate
60 g/L n-methylformanilide (novel dye assistant)
1.0% owg formic acid (90%)
0.5% owg Lanaset Green B (Ciba) (acid dye)

The fabric was dyed with agitation at 250° F. for 60 minutes, cooled to 80° F., rinsed with cool water and dried at 300° F. A green shade was produced, which was the base color for printing. A print paste was prepared as follows:

6.0% guar gum by weight
1.0% by weight formic acid (90%)
0.5% by weight Polar Red RL (Ciba) (acid dye)
Water to make 300 grams total The mixture was stirred vigorously to build viscosity. The print paste was applied to the fabric through a 60 mesh screen.

The fabric was dried at 375° F. until dry and steamed at 212° F. for 5 minutes. Successful printing was achieved.

Example 9

A 10 gram sample of 90% Cationic dyeable polyester/16% Lycra was placed in a 100 ml dye bath containing the following:

1% acetic acid (84%) owg

3% n-methylformanilide owg (novel dye assistant)

3% Basacryl Red GL Liquid (100%) owg

6% Sodium Sulfate owg

Dyeing was carried out at 250° F. for 30 minutes, cooled to 80° F., rinsed with cool water and dried at 300° F. Successful dyeing was achieved.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A dye bath for dyeing an aromatic polyamide fiber substrate comprising:

(a) a dye;

(b) a salt; and (c) a single dye assistant having the formula:

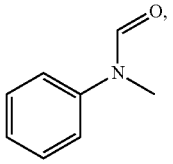

N-methylformanilide thereby facilitating attachment of the dye to the substrate, and wherein the dye bath does not include acetophenone, isophorone, or CINDYE C-45.

2. The dye bath of claim 1, wherein the dye is a basic dye.

3. The dye bath of claim 1, wherein the dye bath includes between about 10 and 70 grams per liter OWB of the dye assistant.

4. The dye bath of claim 3, wherein the dye bath includes between about 20 and 40 grams per liter OWB of the dye assistant.

5. The dye bath of claim 1, further including a pH adjuster.

6. The dye bath of claim 5, wherein the pH adjuster is an organic acid.

7. The dye bath of claim 6, wherein the organic acid is selected from the group consisting of citric acid, formic acid, acetic acid and mixtures thereof.

8. The dye bath of claim 5, wherein the pH of the dye bath is between about 2 and about 5.

9. The dye bath of claim 8, wherein a lower pH produces a deeper depth of shade and a higher pH produces a lighter depth of shade.

10. The dye bath of claim 8, wherein a pH between about 2 and 3.3 produces the deeper depth of shade and a pH between about 3.4 and 5 produces the lighter depth of shade.

11. The dye bath of claim 1, wherein the dye is present in an amount between about 0.1% and 20% OWG.

12. The dye bath of claim 11, wherein the dye is present in an amount between about 1% and 10% OWG.

13. The dye bath of claim 1, wherein the salt is a nitrate.

14. The dye bath of claim 13, wherein the salt is sodium nitrate.

15. A method of dyeing an aromatic polyamide fiber comprising exposing the fiber to a dye in the presence of a single dye assistant having the formula:

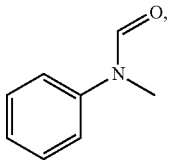

N-methylformanilide thereby facilitating attachment of the dye to the substrate, and wherein the method of dyeing does not include the presence of acetophenone, isophorone, or CINDYE C-45.

16. The method of claim 15, further including adjusting the pH of the exposing to alter pigmentation.

17. The method of claim 16, wherein adjusting is to a lower pH to create a darker pigmentation and to a higher pH to create a lighter pigmentation.

* * * * *